US006533527B1

(12) United States Patent
Inoue et al.

(10) Patent No.: US 6,533,527 B1
(45) Date of Patent: Mar. 18, 2003

(54) BOOM AND BOOM CYLINDER QUICK COUPLER

(75) Inventors: Yonezo Inoue, Chattanooga, TN (US); Allen E. Kimble, Uniontown, OH (US)

(73) Assignee: JRB Company, Inc., Akron, OH (US)

( * ) Notice: Subject to any disclaimer, the term of this patent is extended or adjusted under 35 U.S.C. 154(b) by 0 days.

(21) Appl. No.: 09/638,777

(22) Filed: Aug. 15, 2000

Related U.S. Application Data

(60) Provisional application No. 60/149,037, filed on Aug. 16, 1999.

(51) Int. Cl.[7] ..... E02F 9/00
(52) U.S. Cl. ..... 414/686; 414/723
(58) Field of Search ..... 414/686, 723, 414/722, 694

(56) References Cited

U.S. PATENT DOCUMENTS 4,355,945 A * 10/1982 Pilch ..... 414/686
5,082,389 A * 1/1992 Balemi ..... 414/723 X
5,135,347 A * 8/1992 Kaczmarczk et al. ..... 414/686
5,332,353 A * 7/1994 Arnold ..... 414/723

* cited by examiner

*Primary Examiner*—Donald W. Underwood
(74) *Attorney, Agent, or Firm*—Fay, Sharpe, Fagan, Minnich & McKee, LLP

(57) ABSTRACT

A boom and boom cylinder quick coupler includes a body defining at least one bore about a transverse boom pivot axis, and the bore is adapted for selective alignment with a transverse bore defined in an associated boom. A first transversely extending open recess is defined in the body about a first transverse axis that is parallel to the transverse boom pivot axis. The first recess is adapted for selective receipt of a first pin affixed to an excavator. A second transversely extending open recess is defined in the body about a second transverse axis that is parallel to the first transverse axis. The second recess is adapted for selective receipt of a second pin affixed to the excavator. A boom cylinder quick coupler can also be provided. The boom cylinder quick coupler includes a boom cylinder coupler body that defines a bore about a transverse cylinder pivot axis so that the coupler body is adapted for pivotable connection to first and second associated fluid cylinders by insertion of a pin through the bore of the cylinder coupler body and through aligned bores defined in members connected to first and second associated fluid cylinders. First and second pin-receiving recesses are defined in the boom cylinder coupler body about third and fourth transverse axes that are parallel to the transverse cylinder pivot axis. These recesses are adapted for selective receipt of a associated pins connected to the associated boom.

11 Claims, 5 Drawing Sheets

BOOM AND BOOM CYLINDER QUICK COUPLER

CROSS-REFERENCE TO RELATED APPLICATION

This application claims priority from and hereby expressly incorporates by reference U.S. Provisional Application Serial No. 60/149,037 filed Aug. 16, 1999.

BACKGROUND OF THE INVENTION

The present invention relates generally to coupling devices used by heavy equipment to facilitate selective, secure, and convenient attachment of various implements to the equipment as required to perform certain operations. More particularly, the present invention relates to a quick coupler for the boom and boom cylinders of an excavator that facilitates selective and convenient connection of the boom and boom cylinders to the excavator body and disconnection of same as required for transport of the excavator.

Excavators are well known and widely used in various industries. Typically, excavators include a boom extending from a body of the excavator to an outwardly and upwardly extending distal end, at which end an arm is attached. The arm pivots relative to the boom, and the distal end of the arm is adapted for operative securement of an implement such as a shovel or bucket for removing and depositing earth or other material. Other industries, such as the material handling or demolition industries, employ shears, grapples, magnets, and other implements at the distal end of the arm, and it is not intended that the term "excavator" as used herein be limited to an particular type of implement. Regardless of the type of implement, it will be understood by those of ordinary skill in the art that an excavator employs fluid cylinders and the like for raising and lowering the boom, the arm, for moving the implement relative to the arm, and for operating any mechanisms of the implement, itself.

For purposes of transporting excavators over-the-road on a trailer or the like, it is often necessary to disconnect the boom from the excavator body for separate transport. Heretofore, excavator booms have been attached to the excavator body using a "pin-on" arrangement wherein pins are inserted through aligned apertures formed in the base and boom. Similarly, the boom cylinders, typically two, are pivotally connected to both the boom and the excavator body using pin-on connections. Consequently, boom and boom cylinder removal and replacement has been found to be difficult and time consuming.

To minimize looseness or "play" in these boom and boom cylinder connections, the pins are typically tightly received in the aligned apertures of the boom/body or boom/cylinders. This, then, requires that a hammer or other tool be used to insert and remove the pin. Surrounding structure of the excavator, such as the operator's cab, can restrict freedom of movement and prevent effective use of a hammer or other tools are required in the boom removal/replacement operation. Also, even the operation of aligning the relevant apertures for pin insertion can be time consuming. In general, boom and boom cylinder removal and reconnection has been found to be time consuming, inefficient, and a source of machine down-time that leads to increased expense.

In light of the foregoing, a need has been identified for a boom and boom cylinder quick coupler mechanism for an excavator that facilitates boom and boom cylinder removal and replacement. There has been found a need for such a quick coupler that securely interconnects a boom to an excavator body and that securely interconnects boom cylinders to the boom, while at the same time allowing the boom to be selectively disconnected from the body, and the boom cylinders to be selectively disconnected from the boom, in a convenient manner without undue effort.

SUMMARY OF THE INVENTION

In accordance with the present invention, a new and improved boom and boom cylinder quick coupler is provided.

In accordance with a first aspect of the present invention, a quick coupler base is adapted for connection to an excavator body. The coupler base includes first and second sidewalls projecting upwardly from the excavator body. First and second boom attachment pins extend between and interconnect the first and second sidewalls. The first and second attachment pins are arranged parallel and spaced-apart, and are adapted for selective receipt in first and second pin-receiving regions of an associated boom quick coupler, respectively.

In accordance with a further aspect of the present invention, a boom quick coupler includes a body having at least one aperture therein. The quick coupler is adapted for pivotable interconnection with the proximal end of an associated excavator boom by alignment of the at least one aperture with an aperture of the associated boom. A pin is inserted through the at least one aperture of the coupler body and an aperture in the associated boom to effect pivotable interconnection of the associated boom and coupler body. The coupler body includes first and second pin-receiving regions or hooks that are respectively adapted to receive first and second quick coupler pins of an associated coupler base. Preferably the first and second pin-receiving regions are arranged relative to each other so that the first pin of the base must be received in the first pin-receiving region prior to the second pin of the base being received in the second pin-receiving region to effect proper connection of the coupler to the base. A lock mechanism is connected to the coupler body and includes at least one lock member that is selectively movable between a first or retracted position and a second or extended position. In the second, extended position, the lock member projects outwardly from the coupler body into or adjacent the second pin-receiving region and blocks removal of the second attachment pin from the second pin-receiving region.

In accordance with another aspect of the present invention, a boom cylinder quick coupler comprises a body having an aperture therein. The quick coupler body is adapted for pivotable interconnection with an end of an associated fluid cylinder by alignment of the aperture of the coupler body with an aperture of the associated cylinder. A pin is inserted through the aligned apertures of the coupler body and associated fluid cylinder to effect pivotable interconnection of the associated cylinder and coupler body. The coupler body includes first and second pin-receiving regions or hooks defined therein and adapted for receipt of associated first and second boom attachment pins projecting outwardly from a lateral side surface of an associated boom, respectively. Preferably, the first and second pin receiving regions are arranged relative to each other so that the first pin must be inserted into the first pin-receiving region before the second pin is inserted into the second pin-receiving region to effect proper interconnection of the coupler body and the associated boom. A lock mechanism is connected to the coupler body and includes at least one lock member that is selectively movable between a first, retracted position and a second, extended position. In the extended position, the lock member projects outwardly from the coupler body adjacent or into the second pin-receiving region and blocks removal of the second associated attachment pin from the second pin-receiving region. Preferably, the coupler body comprises like first and second coupler body portions usable to connect the associated boom to first and second fluid cylinders. In such case, the first and second portions are mirror images of one another and the first and second boom attachment pins project from opposite lateral sides of the associated boom. The first and second coupler body portions are interconnected by a cross-member so that a channel is defined therebetween. The channel is adapted for receipt of the associated boom so that the first and second coupler body portions lie adjacent the first and second opposite lateral sides of the boom and are positioned for connection with the first and second attachment pins.

One advantage of the present invention is the provision of a new and improved boom and boom cylinder quick coupler.

Another advantage of the present invention is the provision of a boom and boom cylinder quick coupler for an excavator that facilitates convenient boom removal and replacement as desired.

A further advantage of the present invention resides in the provision of a boom and boom cylinder quick coupler for an excavator that allows for selective boom connection and disconnection without requiring use of tools.

Still another advantage of the present invention is found in the provision of a boom and boom cylinder quick coupler for connecting a boom to an associated excavator body wherein little or no space is required adjacent the boom to facilitate boom removal and replacement.

A further advantage of the present invention resides in the provision of a boom and boom cylinder quick coupler for an excavator that increases excavator efficiency by reducing the time required for boom and boom cylinder connection/disconnection.

Still other benefits and advantages of the present invention will become apparent to those of ordinary skill in the art to which the invention pertains upon reading and understanding the following specification.

BRIEF DESCRIPTION OF THE DRAWINGS

The invention takes form from various components and arrangements of components, preferred embodiments of which are illustrated in the accompanying drawings that form a part hereof and wherein.

DETAILED DESCRIPTION OF PREFERRED EMBODIMENTS

Figure 1:
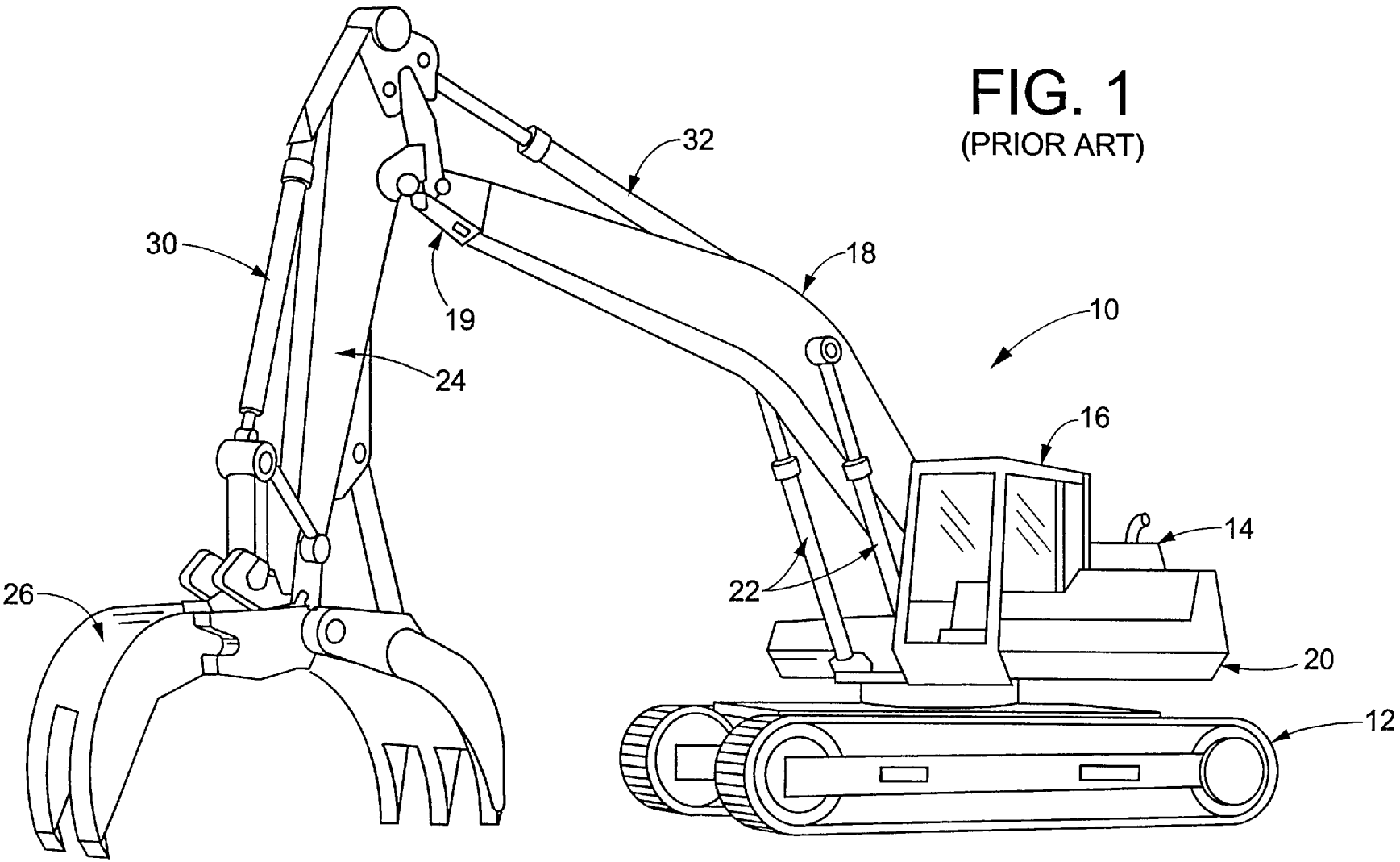
FIG. 1 (PRIOR ART)
FIG. 1 illustrates a conventional excavator and associated boom.
Figure 2:
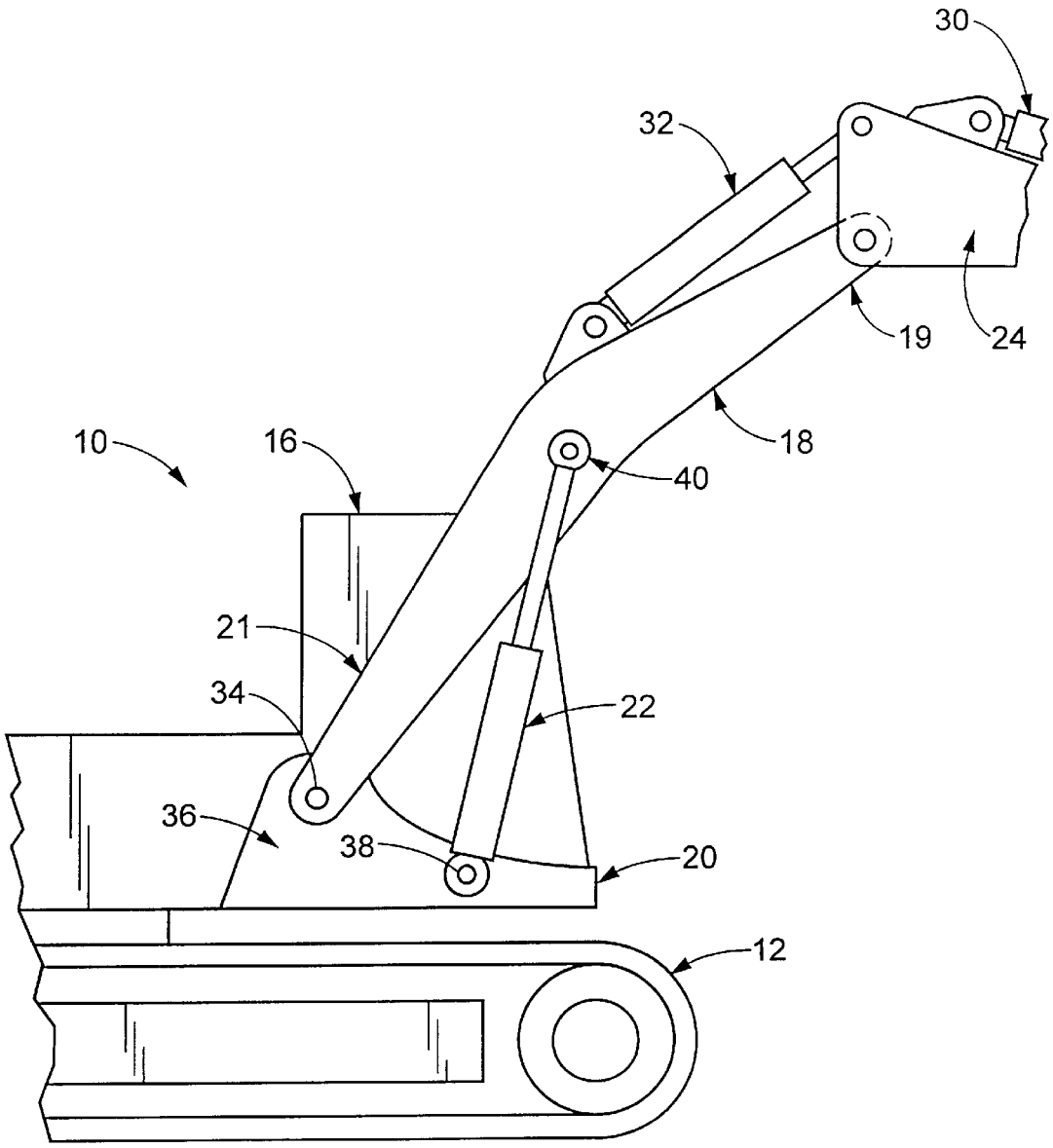
FIG. 2 (PRIOR ART)
FIG. 2 is a partial, diagrammatic side elevational view of the excavator illustrated in FIG. 1 and showing the boom connected to the excavator body by conventional "pin-on" means.

Referring now to the drawings, wherein the showings are for purposes of illustrating preferred embodiments of the invention only and not for purposes of limiting same, FIGS. 1 and 2 illustrate an excavator of the type in connection with which the boom and boom cylinder quick coupler formed in accordance with the present invention may be advantageously employed. The excavator 10 is movable upon tractor or roller chain treads 12 in standard fashion. An engine or power unit 14 such as a diesel engine or the like is operative to drive the treads 12 and the various hydraulic pumps, generators, and systems employed in the operation of the excavator as is well known. A cab 16 is maintained upon a body 20 for accommodating an operator controlling the excavator 10.

A boom 18 extends upwardly from the body 20 and is movable in elevation by means of a pair of like boom hydraulic cylinders 22. At the distal end 19 of the boom 18, an arm or "dipper stick" 24 is pivotally attached. In the embodiment shown, a shovel, bucket, or other implement 26 is maintained at the distal end of the arm 24, and an implement fluid cylinder 30 is operatively connected between the arm 24 and the bucket 26 to control operation of same as is well known and understood by those skilled in the art. In similar fashion, a fluid cylinder 32 is interposed between the boom 18 and arm 24 for achieving pivotal movement between these two members, again in a fashion well known and understood in the art.

Turning now particularly to FIG. 2, it may be seen that the lower, proximal end 21 of the boom 18 is pivotally connected to the excavator body 20 by means of a conventional "pin-on" connection, i.e., a pin 34 is inserted through aligned bores/apertures in the boom 18 and a support bracket 36 affixed to the excavator body. Likewise, the boom cylinders 22 are pivotally connected by pin-on connections to the excavator body 20 and the boom 18 by pins 38, 40, respectively. As noted above, these pin-on connections render boom and boom cylinder removal and replacement difficult and time-consuming.

Figure 3:
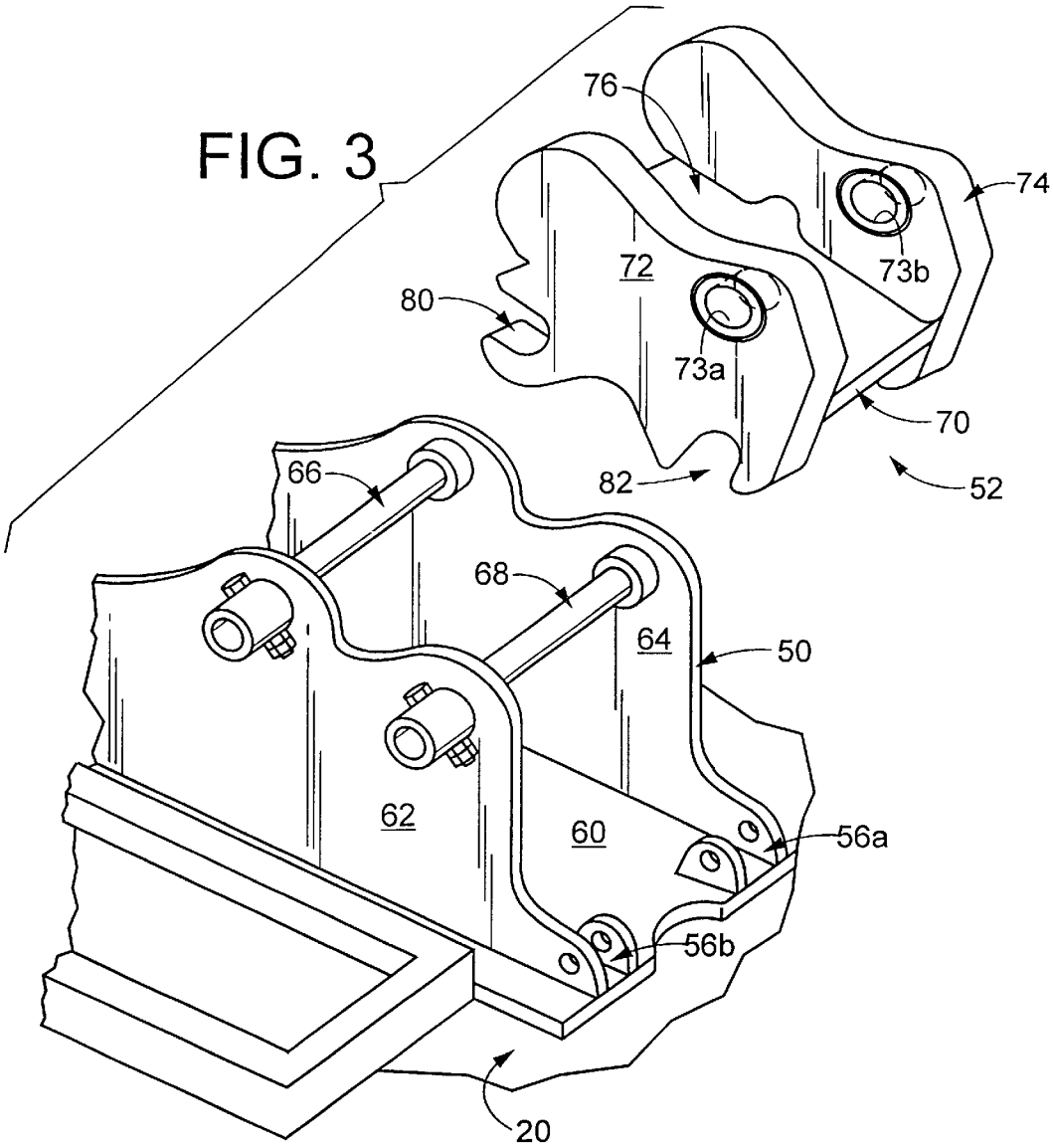
FIG. 3 is a partial exploded perspective view of a boom quick coupler base and boom quick coupler formed in accordance with the present invention.
Figure 5:
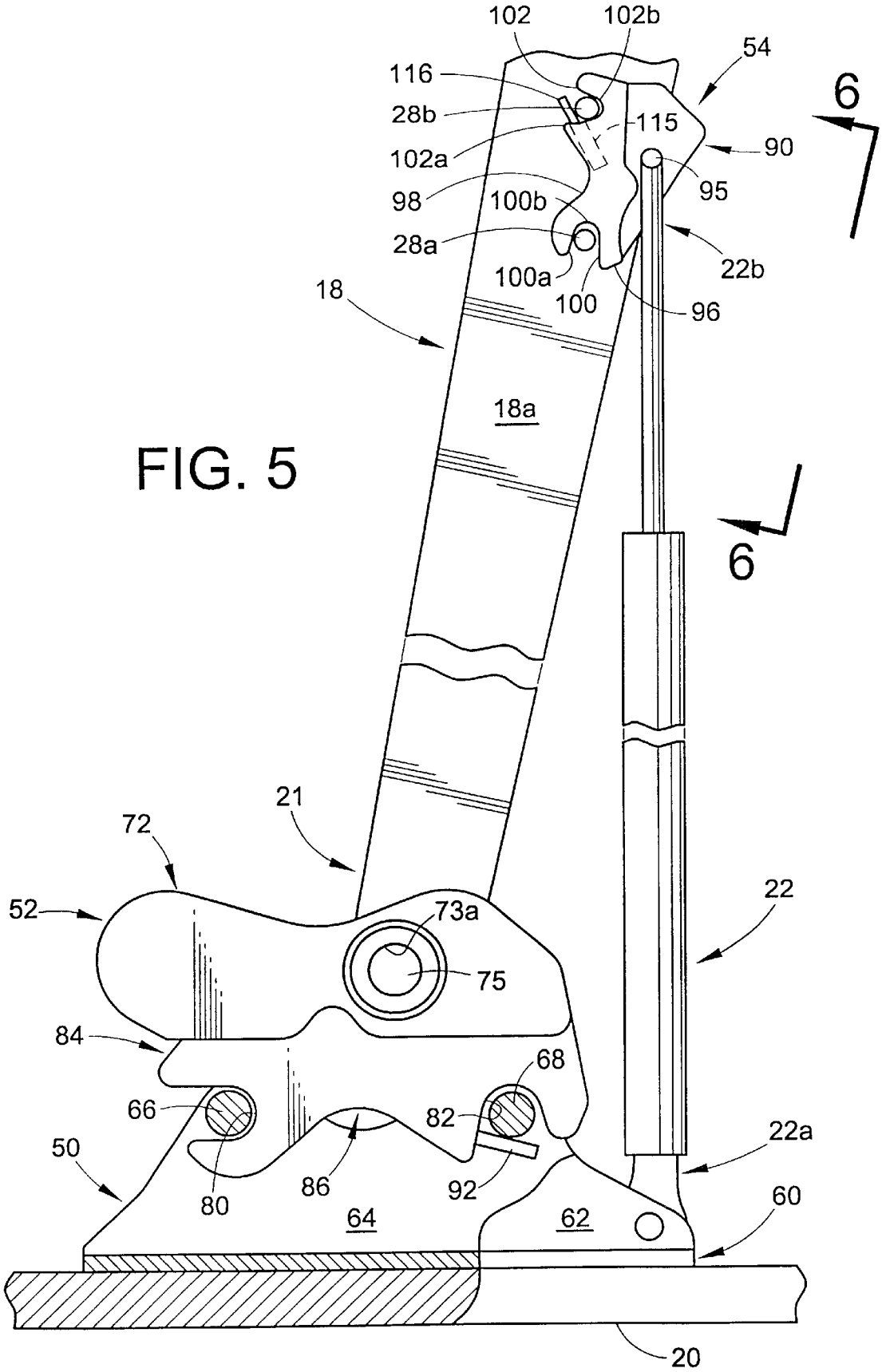
FIG. 5 is a side view, partially in cross-section and partially in elevation, of a boom and boom cylinder quick coupler formed in accordance with the present invention as used to connect an associated excavator body, boom, and boom cylinders; and, FIG. 6 is a view along lines 6—6 of FIG. 5.

In FIG. 5, it may be seen that the boom and boom cylinder quick coupler formed in accordance with the present invention comprises three main components: the boom coupler base 50; the boom coupler 52; and the boom cylinder coupler 54. Referring now also to FIG. 3, the boom coupler base 50, itself, comprises a base plate 60 that is adapted for fixed securement to the excavator body 20 of an associated excavator by suitable, convenient means such as fasteners, welding, or the like. First and second sidewall 62,64 project upwardly or outwardly from the base plate 60 and are preferably parallel and spaced-apart. First and second boom attachment pins 66,68 are fixedly secured to and extend between the sidewalls 62,64. The boom attachment pins 66,68 are preferably arranged parallel and spaced apart relative to each other. The coupler base 50 preferably also comprises first and second boom cylinder attachment brackets or devises 56*a*,56*b*, or like structures for attachment of the boom cylinders 22 by means of a pin or other suitable conventional attachment means.

Figure 4:
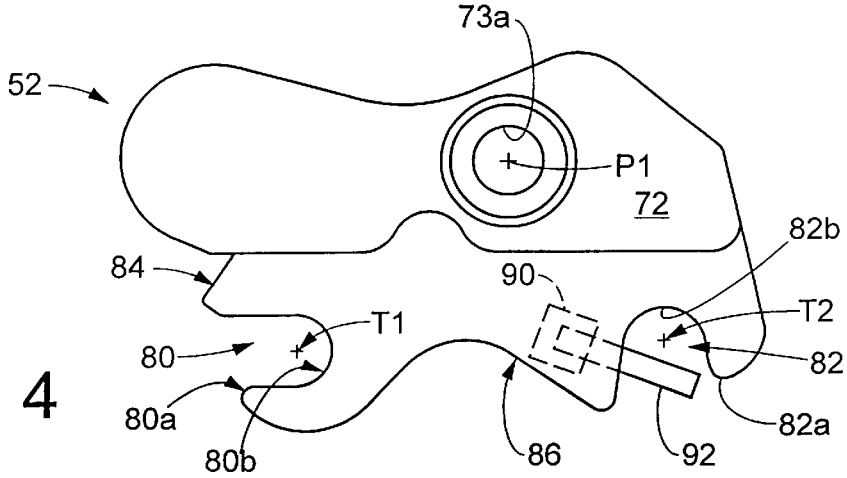
FIG. 4 is a side elevational view of a boom quick coupler formed in accordance with the present invention.

As illustrated in FIGS. 3–5, the boom quick coupler 52 is adapted for selective mating interconnection with the boom coupler base 50. In the illustrated embodiment, the boom coupler 52 comprises a body 70 having first and second sidewalls 72,74 projecting upwardly or outwardly therefrom. Aligned cylindrical bores or apertures 73*a*,73*b* are defined in the sidewalls 72,74, respectively, and are centered on a common transverse boom pivot axis P1 (FIG. 4). The sidewalls 72,74 are arranged parallel and spaced apart relative to each other and define therebetween a channel 76 adapted for receipt of the boom proximal end 21. As seen in FIG. 5, when the boom proximal end 21 is placed in the channel 76, a pin 75 is inserted through the aligned bores 73*a,*73*b* of the coupler body 70 and an aligned bore in the proximal end 21 of the boom 18 to pivotally secure the boom 18 to the coupler body 70 by a pin-on connection.

The coupler body 70 also defines first and second attachment pin-receiving recesses or regions 80,82, conformed in an open groove or hook shape about respective first and second transverse axes T1,T2 (FIG. 4) that are parallel to each other and to the boom pivot axis P1. The first and second recesses 80,82 are specifically designed to mate with the first and second boom attachment pins 66,68, respectively, as illustrated in FIG. 5. Preferably, the first pin-receiving region 80 defines a mouth 80a that opens in a rear or end face 84 of the body, and the second pin-receiving region 82 defines a mouth 82*a* that opens in a lower face 86 of the body 70 at a point spaced relative to the first pin-receiving region 80. Accordingly, the first and second pin-receiving regions 80,82 open in different, generally transverse directions relative to each other. This requires that, in order to mate the coupler body 52 to the base 50, the first pin 66 must be inserted into the first pin-receiving region 80 before the second pin is inserted into the second pin-receiving region 82 (of course, disconnection of the coupler body 52 from the base 50 is accomplished in the reverse order). With continuing reference to FIG. 4, the pin-receiving regions 80,82 define respective innermost ends 80*b,*82*b* located opposite the mouths 80*a,*82*a* that preferably define partially cylindrical (e.g., approximately semi-cylindrical) surfaces centered on the transverse axes T1,T2. These innermost ends 80*b,*82*b* are preferably dimensioned to closely mate with respective outer cylindrical surfaces of the first and second associated pins 66,68.

With continuing reference to FIG. 4, the boom coupler 52 also comprises a lock mechanism 90 that is manually, hydraulically, electrically, or otherwise operable so that a lock member 92 is movable between a first, retracted position (not shown), wherein the lock member 92 does not obstruct the mouth 82*a* of the second pin-receiving region 82, and a second, extended position, as shown in FIGS. 4 and 5, wherein the lock member 92 projects outwardly into the second pin-receiving region 82. As illustrated in FIG. 5, when the coupler body 52 is mated with the coupler base 50, with the pins 66,68 seated in their respective pin-receiving regions 80,82 of the body 52, extension of the lock member 92 to its second position causes a lock member to capture or trap the second pin 68 in the second pin-receiving region 82. This, then, prevents separation of the coupler body 52 from the base 50, given the arrangement of the pin-receiving regions 80,82, that requires the second pin 68 to be removed from the second pin-receiving region 82 before the first pin 66 is removable from the first pin-receiving region 80.

Those of ordinary skill in the art will realize that, as an alternative to the illustrated arrangement, both the first and second pin-receiving regions 80,82 may be defined in the coupler body 70 to open in the same, rather than different directions. In such case, a lock mechanism 90 is provided in association with each pin-receiving region 80, 82 to capture or trap the pins 66,68 therein, respectively.

Figure 6:
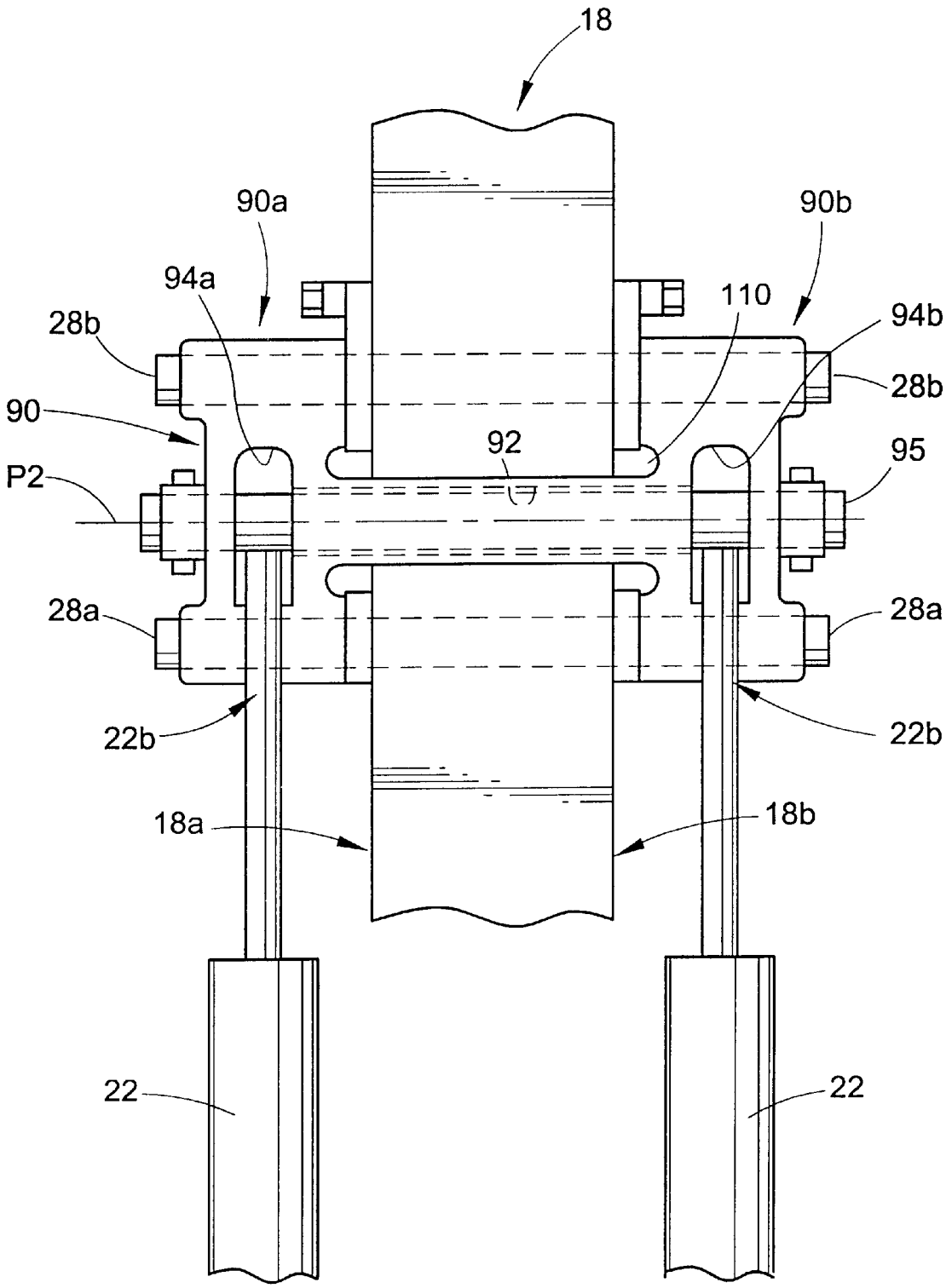

The boom cylinder coupler 54 is illustrated in FIGS. 5 and 6 and is adapted to facilitate interconnection of the boom cylinders 22 to the boom 18. In particular, the boom cylinder quick coupler 54 is adapted to interconnect the boom cylinders 22 to the boom 18 by way of first and second attachment pins 28*a,*28*b* affixed to the boom 18 and projecting outwardly from opposite first and second lateral sides 18*a,*18*b* thereof. A lower,proximal end 22*a* of each boom cylinder is adapted for pivotable connection to the boom coupler base 50 or other location on the body 20 of the associated excavator 10 by pin-on or other suitable conventional means. The opposite, distal end 22*b* of each cylinder 22 (typically the piston rod end) is adapted and includes means for pivotable connection to the boom cylinder coupler body 90 as discussed herein.

In particular, the boom cylinder coupler body 90 comprises a bore 92 (FIG. 6) formed through a first portion thereof. First and second openings 94*a,*94*b* interrupt or intersect the bore 92 and are defined in the body 90 so that apertures formed in the distal end 22*b* of each cylinder 22 (or in a member connected thereto) are able to be placed in alignment with the bore 92 in the coupler body 90. A pin 95 is inserted through the bore 92 and the aligned apertures of the associated boom cylinders 22 so that the cylinders 22 are each pivotably connected to the body 90 by a pin-on connection.

A second portion of the coupler body 90 defines first and second pin-receiving recesses or regions 100,102, each conformed in a groove or hook shape and adapted for receipt of the first and second boom cylinder attachment pins 28*a,*28*b,* respectively. As noted in connection with the boom coupler 52, the pin-receiving regions 100,102 preferably open in different, transverse directions or faces of the body 90 so that the first pin 28*a* must be seated in the first pin-receiving region 100 before the second pin 28*b* is seated in the second pin-receiving region 102. As shown, the first pin-receiving region 100 opens in an end face 96 of the body 90 and the second pin-receiving region 102 opens in an upper face 98 of the body 90 that extends generally transverse to the end face 96. Thus, the first and second pin-receiving regions 100,102 open in generally transverse directions relative to each other. The pin-receiving regions 100,102 define open mouths 100*a,*102*a,* and inner regions 100*b,*102*b* that are located opposite the mouths 100*a,*102*a* define partially cylindrical surfaces centered on respective transverse axes that are parallel to each other and to the boom cylinder pivot axis P2.

The first and second pin-receiving regions 100,102 are interrupted or intersected by a channel 110 extending through the body 90, parallel to the cylinders 22 and boom 18, adapted for receipt of the boom 18 therein. Thus, a first lateral portion 90*a* of the coupler body 90 lies adjacent the first lateral boom surface 18*a,* and a second lateral portion 90*b* of the body 90 lies adjacent the second lateral boom surface 18*b* when the boom 18 is placed in the channel 110 and when the first and second pins 28*a,*28*b* are received in the first and second pin-receiving regions 100,102, respectively.

Referring particularly to FIG. 5, at least one lock or latch mechanism 115 is connected to the coupler body 90 for trapping the second pin 28*b* in the second pin-receiving region 102. The latch mechanism 115 comprises a lock or latch member 116 that is manually, hydraulically, electrically, or otherwise movable between a retracted position (not shown), in which the member 116 does not obstruct the second pin-receiving region 102, and an extended position, in which the member 116 projects outwardly into or adjacent the second pin-receiving region 102 and traps the second pin 28*b* therein. Although only a single latch mechanism 115 is illustrated in FIG. 5, it is preferred that two be provided, one in association with each lateral portion 90*a,*

90*b* of the coupler body 90 so that the second pin 28*b* is trapped in the second pin-receiving region 102 at two locations, one on each lateral side 18*a*,18*b* of the boom 18.

The invention has been described with reference to preferred embodiments. Of course, modifications and alterations will occur to others upon a reading and understanding of the preceding specification. It is intended that the invention be construed as including all such modifications and alterations.

Having thus described the preferred embodiments, what is claimed is:

1. An apparatus comprising:

a boom quick coupler and a boom cylinder quick coupler, said boom quick coupler comprising:

a body defining at least one bore about a transverse boom pivot axis, said bore adapted for selective alignment with a transverse bore defined in an associated boom;

a first transversely extending open recess defined in said body about a first transverse axis that is parallel to said transverse boom pivot axis, said first recess adapted for selective receipt of a first associated pin affixed to an associated excavator;

a second transversely extending open recess defined in said body about a second transverse axis that is parallel to the first transverse axis, said second recess adapted for selective receipt of a second associated pin affixed to the associated excavator; and, said boom cylinder quick coupler comprising:

a boom cylinder coupler body defining a bore about a transverse cylinder pivot axis, said coupler body adapted for pivotable connection to first and second associated fluid cylinders by insertion of a pin through said bore and through aligned bores defined in first and second members respectively connected to said first and second associated fluid cylinders;

a first pin-receiving recess defined in said boom cylinder coupler body about a third transverse axis that is parallel to said transverse cylinder pivot axis, said first pin-receiving recess adapted for selective receipt of a first associated pin connected to the associated boom; and, a second pin-receiving recess defined in said boom cylinder coupler body about a fourth transverse axis that is parallel to said first transverse axis, said second pin-receiving recess adapted for selective receipt of a second associated pin connected to the associated boom; and, a boom-receiving channel that intersects said first and second pin-receiving recesses defined in said boom cylinder coupler body, said boom-receiving channel adapted for receipt of at least a portion of the associated boom therein when said first and second recesses defined in said boom cylinder coupler body respectively receive the first and second associated pins connected to the boom.

2. The quick coupler apparatus as set forth in claim 1, wherein said first and second transversely extending open recesses of said boom quick coupler are conformed in said body so that said second recess is positioned to receive the second associated pin when the first associated pin is seated in said first recess.

3. The quick coupler apparatus as set forth in claim 1, wherein said first and second transversely extending open recesses are each defined to include respective first and second open mouths that open in transverse directions relative to each other.

4. The quick coupler apparatus as set forth in claim 3, wherein said first transversely extending open recess opens in an end region of said body and wherein said second transversely extending open recess opens in a bottom region of said body, said end and bottom regions of said body arranged transverse relative to each other.

5. The quick coupler apparatus as set forth in claim 1, wherein said body comprises:

first and second parallel, spaced-apart sidewalls, wherein said at least one bore comprises first and second cylindrical bores defined respectively through said first and second sidewalls, said first and second bores aligned with each other on said transverse boom pivot axis.

6. The quick coupler apparatus as set forth in claim 5, wherein said first and second sidewalls define therebetween a channel conformed to accommodate a proximal end of the associated boom.

7. The quick coupler apparatus as set forth in claim 1, further comprising:

a boom lock mechanism connected to said body and including a lock member adapted for selective movement between a retracted position and an extended position, said lock member at least partially spanning an open mouth of said second transversely extending open recess when in the extended position to thereby capture a second associated pin in the second transversely extending open recess.

8. The quick coupler apparatus as set forth in claim 1, wherein said first and second transversely extending open recesses are at least partially defined by first and second partially cylindrical surfaces centered on said first and second transverse axes, respectively.

9. In combination with an excavator that includes: (i) a boom; (ii) first and second boom cylinders; (iii) first and second excavator pins connected to the excavator; and, (iv) first and second boom pins connected to the boom, a system for releasably connecting the boom to the excavator and for releasably connecting the first and second boom cylinders to the boom, said system comprising:

a boom quick coupler and a boom cylinder quick coupler, said boom quick coupler comprising:

a body defining at least one bore about a transverse boom pivot axis, said bore adapted for selective alignment with a transverse bore defined in an associated boom;

a first transversely extending open recess defined in said body about a first transverse axis that is parallel to said transverse boom pivot axis, wherein the first excavator pin is received in the first transversely extending recess;

a second transversely extending open recess defined in said body about a second transverse axis that is parallel to the first transverse axis, wherein the second excavator pin is received in the second transversely extending recess;

said boom cylinder quick coupler comprising:

a boom cylinder coupler body defining a bore about a transverse cylinder pivot axis, said coupler body connected to said first and second fluid cylinders by insertion of a mounting pin through said bore and through aligned bores defined in first and second members respectively connected to said first and second fluid cylinders;

a first pin-receiving recess defined in said boom cylinder coupler body about a third transverse axis that is parallel to said transverse cylinder pivot axis, wherein the first boom pin is received in said first pin-receiving recess; and, a second pin-receiving recess defined in said boom cylinder coupler body about a fourth transverse axis that is parallel to said first transverse axis, wherein the second boom pin is received in said second pin-receiving recess.

10. The quick coupler apparatus as set forth in claim 1, further comprising:

at least one boom cylinder lock mechanism connected to said boom cylinder coupler body, said at least one boom cylinder lock mechanism including a boom cylinder lock member that is selectively movable between a retracted position and an extended position, said boom cylinder lock member, when extended, at least partially obstructing said second pin-receiving recess defined in said boom cylinder coupler body.

11. The quick coupler apparatus as set forth in claim 1, wherein said first and second pin-receiving recesses of said boom cylinder coupler body define partially cylindrical inner regions centered on said third and fourth transverse axes, respectively.

* * * * *